US007465258B1

(12) United States Patent
Mortorano

(10) Patent No.: US 7,465,258 B1
(45) **Date of Patent: *Dec. 16, 2008**

(54) EXERCISE DEVICE AND STOPPING DEVICE THEREFOR

(76) Inventor: Michael Peter Mortorano, 3042 N. Monticello, Chicago, IL (US) 60618

( * ) Notice: Subject to any disclaimer, the term of this patent is extended or adjusted under 35 U.S.C. 154(b) by 663 days.

This patent is subject to a terminal disclaimer.

(21) Appl. No.: 10/900,255

(22) Filed: Jul. 27, 2004

Related U.S. Application Data

(63) Continuation-in-part of application No. 10/116,484, filed on Apr. 4, 2002, now Pat. No. 6,860,842, which is a continuation-in-part of application No. 09/974,616, filed on Oct. 6, 2001, now abandoned.

(51) Int. Cl.
*A63B 21/055* (2006.01)

(52) U.S. Cl. ..... 482/126; 482/136; 482/904

(58) Field of Classification Search ..... 482/126, 482/121–125, 48, 49, 136, 908, 129; 102/285.1; 16/428

See application file for complete search history.

(56) References Cited

U.S. PATENT DOCUMENTS

| | | | | |
|---|---|---|---|---|
| 4,019,734 | A | 4/1977 | Lee et al. | |
| 4,026,549 | A | 5/1977 | Gunn | |
| 4,093,211 | A | 6/1978 | Hughes et al. | |
| D263,326 | S | 3/1982 | Cooper | |
| 4,375,886 | A | 3/1983 | Muys | |
| 4,733,862 | A | 3/1988 | Miller | |
| 4,911,439 | A | 3/1990 | Kuhl | |
| 5,022,648 | A | 6/1991 | Travis | |
| 5,514,059 | A | 5/1996 | Romney | |
| 5,549,532 | A | 8/1996 | Kropp | |
| 5,571,064 | A | 11/1996 | Holm | |
| 5,643,149 | A * | 7/1997 | Grimaldi et al. | 482/82 |
| 5,791,022 | A | 8/1998 | Bohman | |
| 6,006,671 | A * | 12/1999 | Yunan | 102/275.11 |
| 6,022,302 | A | 2/2000 | McBride | |
| 6,036,626 | A | 3/2000 | Taylor | |
| 6,238,324 | B1 | 5/2001 | MacMillan | |
| 6,398,698 | B1 | 6/2002 | Hinds | |
| 6,524,226 | B2 | 2/2003 | Kushner | |
| 6,860,841 | B1 * | 3/2005 | Mortorano | 482/126 |

* cited by examiner

*Primary Examiner*—Jerome Donnelly

(57) ABSTRACT

An exercise device, having a pair of handles—namely a first handle and second handle, and an elastic cord extending through the handles. The elastic cord has a fixed end, the first handle located adjacent to the fixed end. The second handle located along the elastic cord further away from the fixed end than the first handle. The second handle can selectively slide freely along the elastic cord toward and away from the first handle. A novel stopping device is attached to at least one of the first handle and second handle, which is capable of fixing the position of its associated handle along the elastic cord so that the elastic cord may then be tensioned to allow exercises to be performed. The novel stopping device includes a keyhole type slot for the cord terminating in a circular opening and forming a pair of pinch points with a tapering slot whereby the cord is securely held in the circular opening against slippage or accidental removal from the opening.

18 Claims, 5 Drawing Sheets

EXERCISE DEVICE AND STOPPING DEVICE THEREFOR

CROSS REFERENCES AND RELATED SUBJECT MATTER

This application is a continuation-in-part of patent application Ser. No. 10/116,484, filed Apr. 4, 2002, now U.S. Pat. No. 6,860,842, issued Mar. 1, 2005; which is a continuation-in-part of application Ser. No. 09/974,616, filed Oct. 6, 2001, now abandoned.

BACKGROUND OF THE INVENTION

The invention relates to an exercise device. More particularly, the invention relates to an exercise device which employs an elastic cord and a pair of handles to allow a variety of exercises to be performed, such that one or more of the handles has a stopping device which allows the user to selectively fix the position of the stopping device along the elastic cord so that the electric cord can be tensioned between the two handles.

For those who seek to maintain a toned physique, it is essential to keep a consistent exercise schedule in which exercises are performed that isolate target muscle groups. Since weight lifting and resistance based exercise machines are a typical part of such a regimen, frequent travel to the gym is a necessity.

Considering the work, school and travel schedule of many individuals, it is not always possible to travel to the gym. Rather than skip the workout altogether, many athletes will perform stretching exercises, push-ups, sit-ups, etc. Although such exercises are good for maintaining overall conditioning, they lack the ability to isolate and tone specific muscles.

Some attempts have been made to provide compact and lightweight devices for performing toning exercises at any location. One such type of exercise device employs an elastic cord, and a pair of handles fixed to the ends of the cord. Such portable exercising devices are generally inexpensive, convenient for use, and are useful for physical conditioning—particularly in exercising upper body muscles. The typical elastic exercising device provides resistance against which the user exerts force during exercising.

However, many elastic exercising devices provide only constant resistance, which limits such devices to being used to exercise only particular muscles or group of muscles. In addition, such devices fail to challenge a user as the user's strength increases.

U.S. Pat. No. 5,514,059 to Romney attempts to solve the problem by having a flexible tubular member, located midway between the handles, from which a loop of cord is drawn out to adjust the distance between the handles, and wrapped around the tubular member with a strap, purportedly to hold the loop of cord in place during exercise. However, such an arrangement cannot reliably maintain the length adjustment and resist the cord tension exerted by a strong user. Further, if the strap were to fail and the loop were to be suddenly released while the device is in use and under tension, it would very likely injure the user.

U.S. Pat. Nos. 5,571,064 to Holm, 6,036,626 to Taylor, and 6,238,324 to MacMillan all disclose various exercise devices which employ an elastic cord in various configurations. U.S. Pat. Nos. 6,022,302 to McBride and 5,022,648 to Travis disclose exercise devices which use a flexible tube to provide resistance.

While these units may be suitable for the particular purpose employed, or for general use, they would not be as suitable for the purposes of the present invention as disclosed hereafter.

SUMMARY OF THE INVENTION

It is an object of the invention to provide an exercise device which is capable of toning individual muscle groups of a user, as well as quickly "pumping up" the muscles of the user. Accordingly, the invention provides an exercise device which is useable in a variety of different positions, and adaptable to a variety of different exercises to meet such goals.

It is another object of the invention to provide an exercise device which is portable and inexpensive. Accordingly, in simple terms, the exercise device comprises an elastic cord, and a pair of handles, each handle preferably having a stopping device integrated with the handle. The components of the exercise device are lightweight, and are simple in construction so that they may be inexpensively manufactured and assembled.

It is a further object of the invention that the exercise device can be easily adjusted to vary the resistance and distance between the handles to accommodate different exercises and different users. Accordingly, at least one of the handles is movable along the cord to set a desired position relative to the other of the handles, yet is then prevented from movement along the elastic cord by the stopping device.

It is still another object of the invention to provide an end stopper member for an elastic cord which securely locks to the marginal end of the cord and functions to prevent a member, such as a handle, through which the cord passes from sliding or slipping off the end of the cord when the cord is not locked in position to the handle by the stopping device.

Another object of the invention is to provide a stopping device for an elastic cord secured to a handle through which the cord passes, the stopping device maintaining the handle at a selected position along the cord and preventing movement of the handle relative to the cord, and providing means to stow the end of the cord at an end of the handle.

These and other objects and advantages of the present invention will be apparent to those skilled in the art from the following description and accompanying drawings.

The invention is an exercise device, having a pair of handles—namely a first handle and second handle, and an elastic cord extending through the handles. The elastic cord has a fixed end, the first handle located adjacent to the fixed end and prevented from movement past the fixed end. The second handle is located along the elastic cord further away from the fixed end than the first handle. The first handle and second handle can slide freely along the elastic cord toward and away from each other. A stopping device is located on the second handle fully opposite from the first handle. The stopping device is capable of allowing adjustment of the relative position of the second handle along the cord and selectively locking to the elastic cord to prevent the second handle from moving so that the elastic cord may then be tensioned to allow exercises to be performed.

In another embodiment, the invention also includes a novel end stopping member for an elastic cord which securely locks the member to the marginal end of the cord and functions to prevent another member, through which the cord passes, such as a handle as described above, from sliding or slipping off the end of the cord to which the stopping member is secured. The stopping member is desirably, irreversibly, compressible, and preferably is a nut which is sized to permit the cord to pass therethrough for easy assembly. After the cord is passed through, the stopping member is placed in the desired position, for example near an end of the cord, and is compressed to securely lock the stopping member to the cord.

The embodiment may also include an enclosure for a marginal end of the cord and the stopping member secured to the marginal end of the cord. In addition in this embodiment, the enclosure is stowable in a receiver for the enclosure, the receiver extending from the stopping device. In one preferred form the enclosure is preferably a ball and the receiver is a socket portion of the stopping device into which the ball can be releasably secured.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
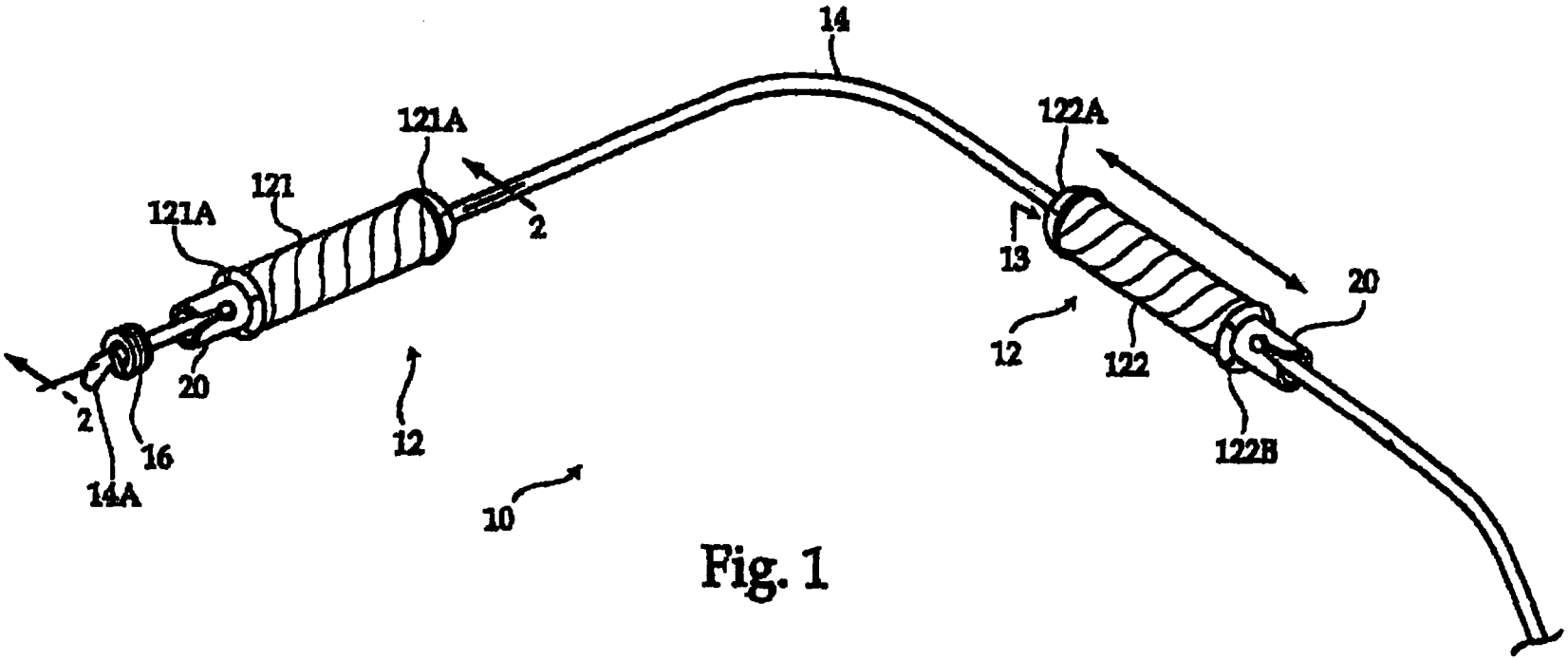
FIG. 1 is a diagrammatic perspective view, illustrating one embodiment of the invention.

FIG. 1 illustrates an exercise device 10. The device 10 includes a pair of handles 12, each having a central longitudinal bore 13, and an elastic cord 14 which extends through the central longitudinal bore 13 of both handles 12. The elastic cord 14 has a relaxed diameter when substantially un-tensioned, and has a tendency to narrow when tensioned and stretched.

In the embodiment shown in FIGS. 1-5, the handles 12 include a first handle 121 and a second handle 122. The elastic cord 14 has a fixed end 14A having a fixed coupling 16. The first handle 12 is located nearest to the fixed end 14A. The fixed coupling 16 may be employed to prevent the first handle 12 from moving past the fixed end 14A, and in effect limits longitudinal movement of the first handle 121 along the elastic cord 14. The first handle 121 and second handle 122 each have inner ends 121A and 122A, and outer ends 121B and 122B. The inner ends 121A and 122A face each other, while the outer ends 121A and 122B are fully opposite and face away from each other.

The second handle 122 is located on the elastic cord 14 further away from the fixed end 14A than the first handle 121. The second handle 122 is ordinarily freely movable along the elastic cord 14—both toward and away from the first handle 121.

Figure 3:
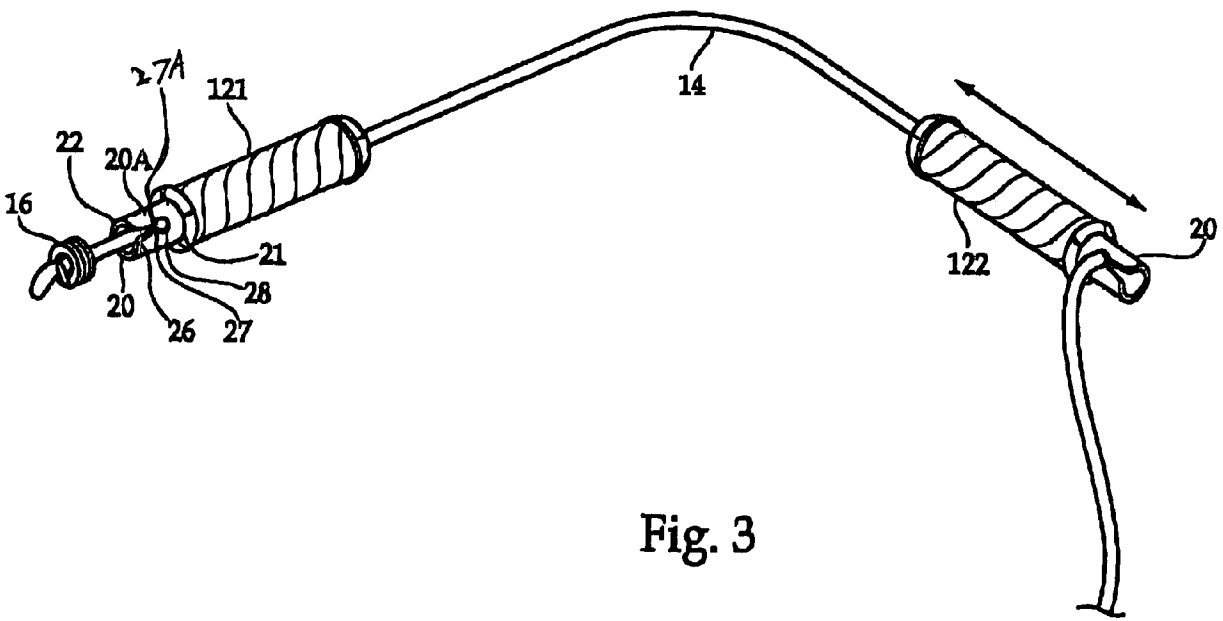
FIG. 3 is an elevational view wherein the stopping device of the present invention is being used to fix the position of the second handle on the elastic cord.

The second handle 122 has a stopping device 20 at its outer end 122B, thus located further on the elastic cord than the remainder of the second handle 122. The stopping device 20 allows the second handle 122 to be selectively moved along the elastic cord 14, as seen in FIG. 1, and selectively locked in position on the elastic cord 14 as seen in FIG. 3 to act as a stop for the second handle 122, to prevent the second handle 122 from moving further away from the first handle 121 along the elastic cord 14. In addition, the stopping device 20 can also prevent the second handle 122 from moving toward the first handle 121. Generally, when the exercise device 10 is in use and being tensioned, the user would be pulling the handles away from each other, and such movement is limited by the stopping device 20 at the second handle 122, and by the fixed coupling 16 at the first handle 121.

However, as illustrated in the drawings figures, the first handle 121 may also have the stopping device 20 at its outer end 121B. The stopping device 20 of the first handle 121 can be used to selectively prevent movement of the first handle 121 along the elastic cord 14. Accordingly, during usage of the exercise device, the user can choose to rely upon the fixed coupling 16 to simply limit movement of the first handle 121 away from the second handle, or can use the stopping device 20 of the first handle to actually fix a position of the first handle 121 on the elastic cord 14.

Figure 2:
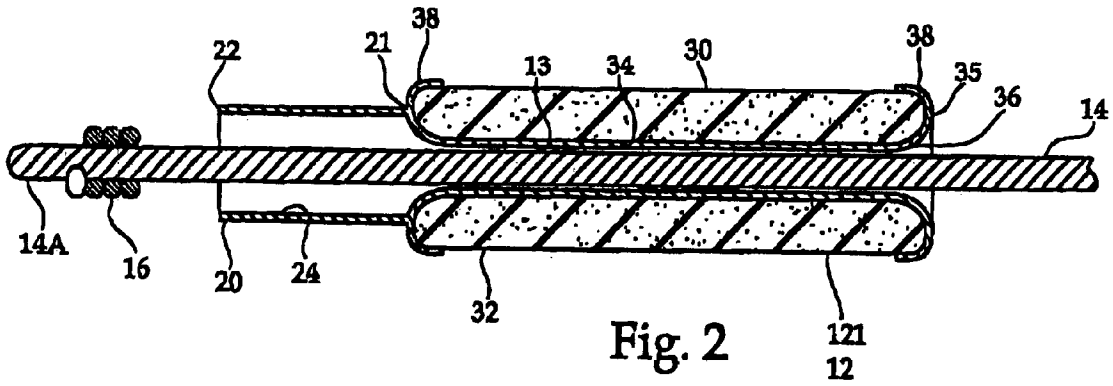
FIG. 2 is a cross-sectional view, taken generally in the direction of line 2-2 in FIG. 1.

FIG. 2 is a cross-sectional view, illustrating the first handle 121. It is specifically the first handle 121, because of its orientation and its illustrated proximity to the fixed coupling 16 and the fixed end 14A. However, structurally it is substantially the same as the second handle 122 or at least a mirror image thereof, so it may be referred to as simply "the handle 12".

The handle 12 compromises a handle tube 30 which is soft, pliable, flexible, yet strong, and is preferably made of foam or rubber. The handle tube 30 has a handle tube exterior 32, a handle tube bore 34, and a pair of handle tube ends 35. The handle tube exterior 32 is grasped by the user during use. A collar tube 36 extends through the handle tube 30, through the handle tube bore 34. The collar tube 36 is rigid, typically made of metal, although as hereinafter described can be formed of a rigid plastic material, and has a pair of curled ends 38. The elastic cord 14 specifically extends through the collar tube 36. The curled ends 38 of the collar tube 36 prevent abrasion to the elastic cord 14, and thus prevent undue wear to said cord 14 as the exercise device 10 is used. The curled ends 38 flare outward from the handle tube bore 34 at the handle tube ends 35, to cover the handle tube ends and thus maintain the handle tube 30 in position around the collar tube 36. Thus, each of the curled ends 38 on one of the handles 12 preferably also return inward toward the other curled end 38 on said handle 12, making a substantially one hundred eighty degree turn which overlaps the handle tube exterior 32 and fully integrates the handle tube 30 with the collar tube 36, and prevents it from sliding or slipping off the collar tube 36.

The stopping device 20 extends from the collar tube 36, at the outer end 121B of the handle tube 30, and is shown to extend specifically from the curled end 38 of the collar tube 36. The stopping device 20 is tubular, coaxial with the handle, having a first stopping device end 21 and a second stopping device end 22. A stopping device bore 24 extends between the stopping device ends 21 and 22, through which the elastic cord 14 extends. Thus, the stopping device bore 24 is substantially coaxial with the handle tube bore 34 and central longitudinal bore 13 of the handle 12.

Referring to FIG. 3, the stopping device 20 has a side wall 20A having a slot 26 which extends from the second stopping device end 22 partially toward the first end 21, and slightly less in width, or tapered to be slightly less in width, than the diameter of the elastic cord 14 when relaxed. The slot 26 is cut into the side wall 20A, and thus extends parallel to the stopping device bore 24. The slot 26 has a neck 27, which forms pinching points 27A (FIG. 3), which is the narrowest portion of the slot 26 and is fully opposite from the second end 22. Adjacent to the slot 26 is a circular opening 28, which is slightly larger than the neck.

Figure 4:
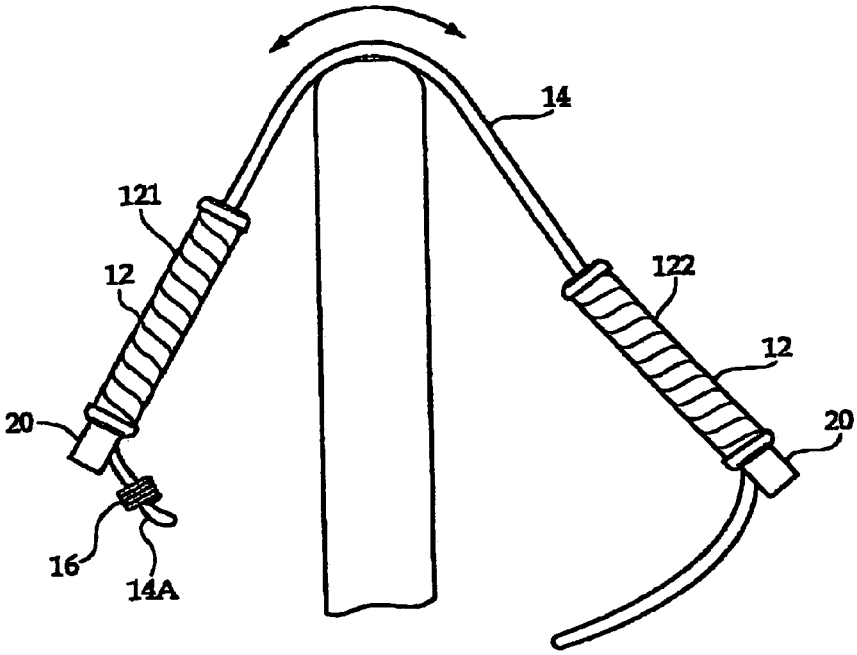
FIGS. 4 and 5 are side elevational views, illustrating different operative positions, wherein the handle positions have been set by the user as desired, and the invention is shown being pulled downward over a fixed item by the handles to tension the elastic cord.
Figure 5:
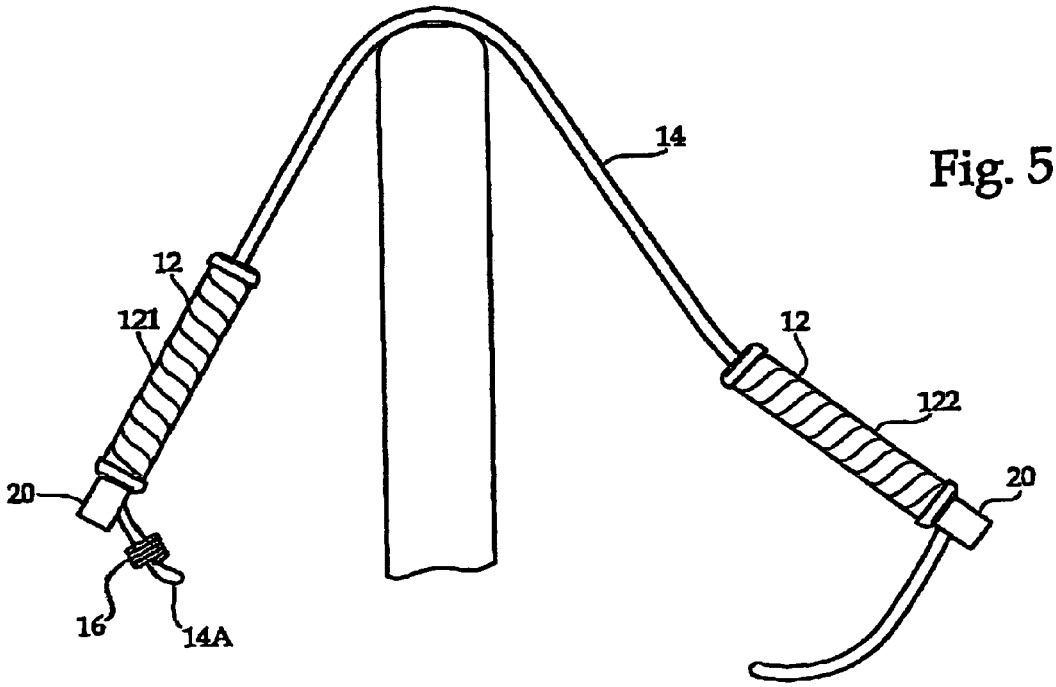

To move the stopping device 20 along the elastic cord 14, the elastic cord 14 must extend coaxially between the first end 21 and second end 22 of the stopping device 20. Then the handle 12 associated with said stopping device 20 can move freely along the elastic cord 14, and the elastic cord 14 can move therethrough. However, to fix the position of the handle 12 along the elastic cord, the cord 14 is held rigidly near the inner end 121A or 122A of the handle 12, and is pulled adjacent to the second end 22 of the stopping device 20 toward the outer end 121B or 122B of said handle 12 at a right angle to the second end 22 of said stopping device 20 and the axis of the cord 14; stretching and thus narrowing the elastic cord 14; urging the elastic cord 14 into the slot 26 and towards the neck 27; and then pulling the elastic cord 14 past the neck 27 and pinching points 27A until it enters the circular opening 28 at a right angle. When released, the elastic cord 14 will expand slightly within the circular opening 28. Because of the narrowing of the slot 26 and the pinching points 27A, and the slightly larger circular opening 28, most of the diameter of the cord, for example, approximately 80% of the cord 14 has a tendency to stay in the circular opening preventing less damage to the cord as compared to damage to the cord if it remained at the narrowest end of the tapered slot, and the remaining approximately 20% of the cord is pinched by the two pinching points and locks into the body of the cord, locking it better than in other devices having only a tapered slot. In addition, cord 14 remaining in the circular opening, prevents the cord slipping therefrom, whereas in other devices which may use only a tapered slot, the slot allows the cord to slip out of slot when under tension. Cord 14, in this invention, remains at a right angle from the remainder of the elastic cord 14 and from the stopping device 20, as illustrated in FIGS. 3, 4 and 5. This bend acts to prevent the elastic cord 14 from longitudinal movement. In this locked position the stopping device 20 will not move along relative to the elastic cord 14. Thus, referring to FIG. 4 and FIG. 5, when so locked, the second handle 122 cannot move along the elastic cord 14. Accordingly, during exercises any tension against the handles 12 will in turn tension the elastic cord 14—as desired. Alternatively, if only the second handle 122 is fixed in position, the first handle 121 is slid to its extreme position at the fixed end 16, and then the elastic cord 14 can be tensioned by pulling the first handle 121 and second handle 122 away from each other.

FIG. 4 and FIG. 5 illustrate two different operative positions for the handles 12. The stopping devices 20 are both in use, holding the adjustment of the handles 12 along the elastic cord 15. The handles 12 have been adjusted in FIG. 5 so that the handles 121 and 122 are further away from each other than in FIG. 4. After selecting a desired exercise, the user would suitably adjust the second handle 122 and possibly the first handle 121. If the first handle 121 is not going to be fixed in position, to set a minimum position—that is the minimum distance between handles desired for the chosen exercise—the first handle 121 is slid along the elastic cord 14 until it abuts the fixed coupling 16 at the fixed end 14A. Alternatively, other means could be used to permanently fix the position of the first handle 121 with respect to the elastic cord 14. Then, the position of the second handle 122 is locked with its stopping device 20 in the manner previously described. Once the minimum exercise distance (or the limit of untensioned travel) is set, various exercises can be performed by tensioning the elastic cord by pulling the handles away from each other.

However, if the first handle 121 is also to be selectively fixed in position along the elastic cord 14 by using its stopping device 20, then the "minimum distance" is strictly relative between the handles 121 and 122, and can be established at various points along the elastic cord 14.

It should be noted that in FIG. 1, the elastic cord 14 is shown as having arbitrary length, with no end shown opposite the fixed end 14A. The actual length of the cord 14 can be chosen according to an anticipated range in the size of the users and of the types of exercises that may be performed. Further, another limiting device, liked the fixed coupling 16 or equivalent structures, may be placed opposite the fixed end 14A, so that both ends have such fixed couplings 16 or suitable limiting devices.

Figure 6:
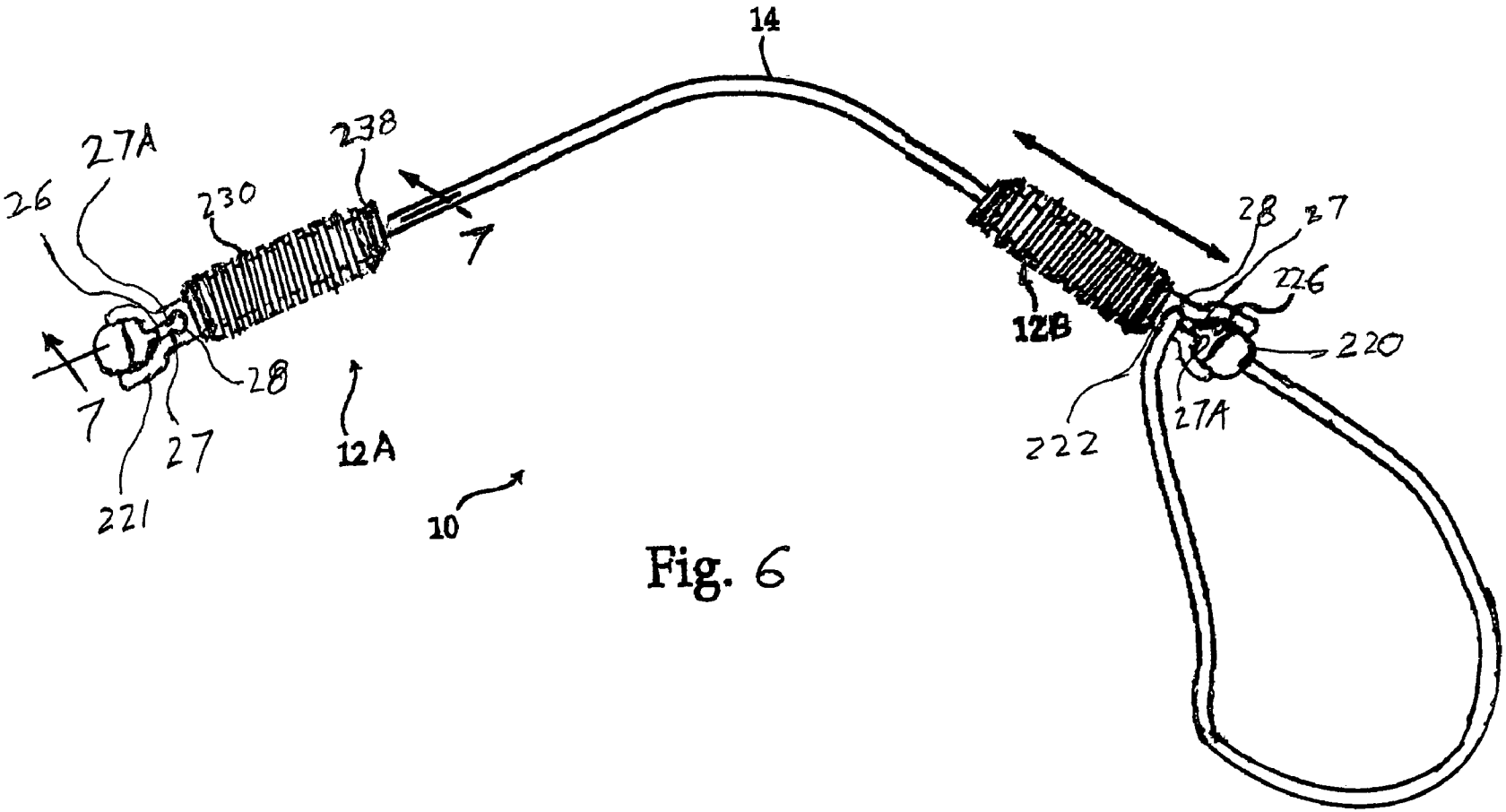
FIG. 6 is a diagrammatic perspective view, illustrating another embodiment of the invention.
Figure 7:
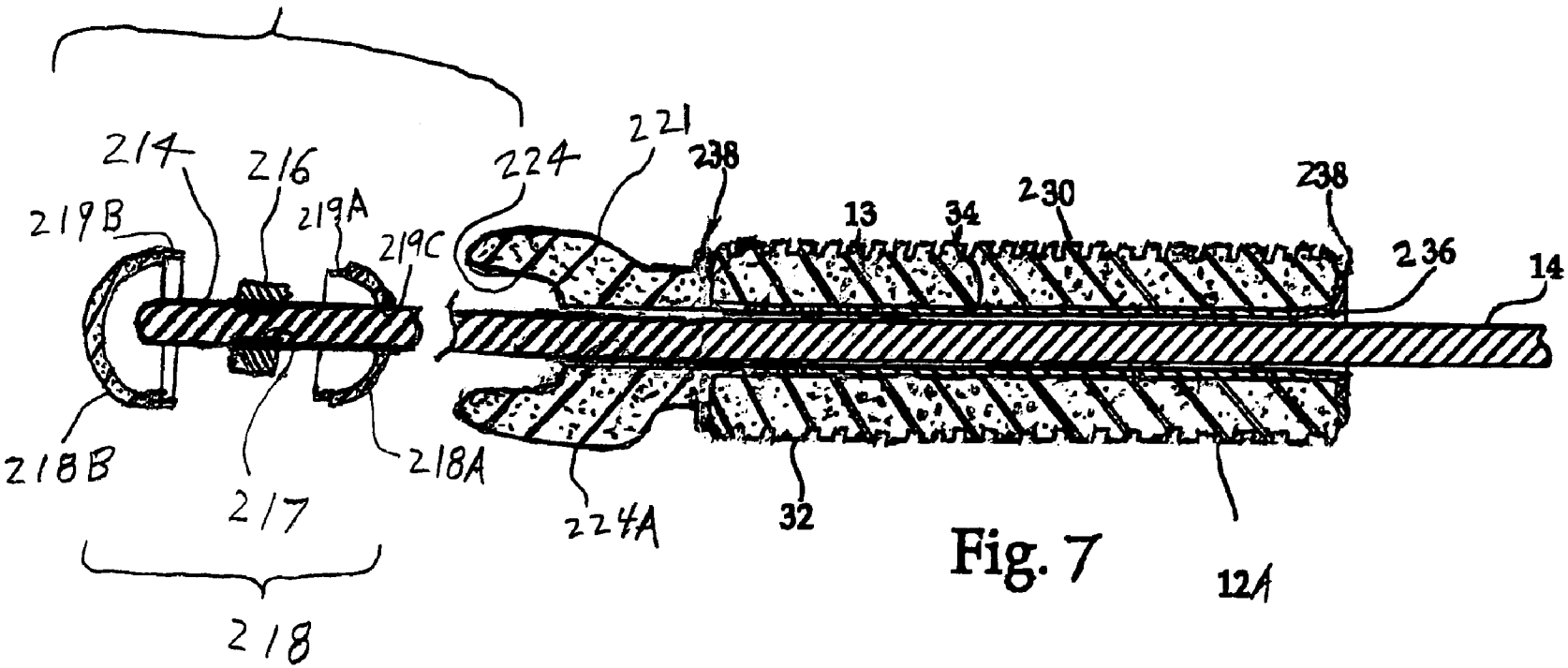
FIG. 7 is a partially exploded cross-sectional view, taken generally along line 7-7 in FIG. 6.

In the embodiment illustrated in FIGS. 6 and 7, elements of the invention which are the same or substantially the same as elements of the embodiment shown in FIGS. 1-5 are referred to by the same reference numerals, and their description and interaction are not further described here for the sake of brevity.

In this embodiment, fixed coupling 16 at the marginal end 214 of cord 14 is replaced by a compressible stopping member (FIG. 7), preferably a metal nut 216, as shown, which upon compression with cord 14 passing therethrough, such as compression in a vise, forces nut 216 to compress the portion of the cord 217 passing through the stopping member. In this manner, the nut 216 is firmly secured to the marginal end of cord 14, and prevents handle 12A from slipping off the end of cord 14. In a similar manner, a second stopping member (not shown), preferably also a nut, is placed on the opposite marginal end of cord 14 and compressed thereon to prevent handle 12B from slipping off the corresponding end of cord 14. The second stopping member is not seen in FIG. 6 as it is within an enclosure, as will be hereinafter described.

Marginal end 214 of cord 14 and stopping member, for example, nut 216 compressed onto marginal end 214 of cord 14, is enclosed in an enclosure, preferably a ball 218, as best shown in FIG. 7 in an exploded view. The opposite marginal end of cord 14 and the second stopping member is enclosed in an identical ball 220. Balls 218 and 220 are preferably formed in two halves of rigid plastic 218A and 218B, which may be fitted to each by means of closely fitting annular shoulders 219A and 219B, or by other means such as cementing the two halves to each other. Ball half 218A has a circular hole 219C at the apex of its arc to accommodate cord 14 passing therethrough.

In this embodiment of the invention, a receiver or socket 224 is provided as a portion of stopping device 221, 222. Preferably, socket 224 is of a relatively rigid plastic, and is molded integrally with the stopping device 221, 222, collar tube 236 with its end collars 238 which retains soft, pliable, flexible handle tube 230, which is similar to handle tube 30 in the embodiment illustrated in FIGS. 1-5. Socket 224 is configured to snugly and releasably retain ball 218 in a pocket 224A of socket 224. An identical socket portion 226 is provided integrally with handle 12B, which is configured to snugly and releasably retain ball 220.

Socket 224, 226 has an axis aligned with the bore of stopping device 221, 222 and bore 34 of the handle. Socket 224, 226 has a wall 224A (FIG. 7) having an opening therein extending from the widest end of slot 26 and aligned with slot 26, so that cord 14 may readily pass therethrough for positioning handle 12A along cord 14.

Ball 218 containing a marginal end 214 of cord 14 and nut 216 can be snugly retained in socket 224 so that handle 12A is positioned at or near the marginal end 214 of cord 14. In this event, slot 26 of stopping device 221 is not utilized. Cord 14 simply passes through the bore of the stopping device 221 in this case. Alternatively, where it is desired to position one of the handles, such as handle 12B, other than at a marginal end of cord 14, the cord 14 at the stopping device at the selected position can be held and pulled at a right angle to the stopping device and urged through the opening in wall 224A and socket 226 into slot 26, towards neck 27 and beyond pinching points 27A into circular opening 28, as shown in FIG. 6 with respect to handle 12B. The remainder of cord 14 extending from circular opening 28 of stopping device 222 can be looped so that the ball 220 with the marginal end 214 extending outwardly from ball 220 is snugly fitted into the socket 226 portion of device 222 as shown in FIG. 6.

In conclusion, herein is presented an exercise device which allows a variety of toning and pumping exercises to be performed, while allowing adjustment for different users and for different exercises. The exercise device, in one embodiment, is especially esthetically pleasing through the use of molded handles of relatively rigid plastic and the ends of the cords enclosed in plastic balls, which are snugly releasably in receiving sockets integral with the handles. The invention is illustrated by example in the accompanying drawing figures and in the foregoing description. However, numerous variations may be made while adhering to the inventive concept. Such variations are considered a part of the present invention.

What is claimed is:

1. An exercise device comprising:

an elastic cord, a handle of an exercise device including the elastic cord, the handle having a bore through which the cord passes, said stopping device comprising a member having a first end and a second end and a bore therethrough through which the cord passes, the bore of the member and the bore of the handle being axially aligned, said member having a side wall having a slot extending parallel to the bore from said first end of the member toward said second end thereof, said slot tapering and narrowing from said first end toward said second end and terminating in a circular opening at least slightly larger than the narrowed end of the slot and forming a pair of pinch points therewith, wherein said cord passing from the bore into the slot at the first end of the member may be pulled through the slot at a right angle to the bore past the pair of pinch points and into the circular opening to permit the cord to expand slightly as it passes the pinch points and locks the cord in the circular opening of the stopping device whereby the handle integral with the stopping device is prevented from moving along the cord.

2. The stopping device of claim 1, wherein the second end of the member of the stopping device is integral with and the member extends axially from the handle.

3. The stopping device of claim 2 further comprising a receiving portion for retaining a marginal end of the cord.

4. The stopping device of claim 3, wherein the receiving portion of the member extends longitudinally away from the handle and the axis of the portion is axially aligned with the bores of the member of the stopping device and the handle, whereby the cord passes therethrough.

5. The stopping device of claim 4, wherein the receiving portion has a wall having an opening therein extending parallel to the bore and aligned with and open to the slot in the member of the stopping device, whereby the cord passes through the opening in the wall of the receiving portion and into the slot in the member of the stopping device generally at a right angle to the aligned bores of the member and the handle.

6. The stopping device of claim 4, wherein the receiving portion is adapted to receive an enclosure enclosing the marginal end of the cord.

7. The stopping device of claim 4, wherein the receiving portion is adapted to receive a spherical member enclosing the marginal end of the cord.

8. The stopping device of claim 6, wherein the receiving portion is adapted to receive a spherical member enclosing the marginal end of the cord and the spherical member further enclosing a stopping member affixed to the cord at a marginal end thereof, whereby the spherical member is prevented from slipping off the end of the cord adjacent said marginal end.

9. An exercise device comprising:

a. a pair of handles, including a first handle and a second handle each having an inner end and an outer end and each having a longitudinal central bore therethrough;

b. an elastic cord extending longitudinally through the bores of said handles wherein the handles are slidable along the cord toward and away from each other and wherein the inner ends of the handles face each other; and c. a stopping device affixed to the outer end of each handle, each stopping device comprising a member having a first end and a second end and having a bore therethrough through which the cord may pass, and a side wall having a slot extending parallel to the bore from said first end of the member toward said second end thereof, said slot tapering and narrowing from said first end toward said second end and terminating in a circular opening at least slightly larger than the narrowed end of the slot and forming a pair of pinch points therewith, wherein a cord passing from the bore into the slot at the first end of the member may be pulled through the slot at a right angle to the bore past the pair of pinch points and into the circular opening to permit the cord to expand slightly as it passes the pinch points and locks the cord in the circular opening of the stopping device, whereby the handle integral with the stopping device is prevented from moving along the cord.

10. The exercise device of claim 9, wherein each stopping device is integral with the outer end of a handle, the bore of the member of the stopping device and the bore of the handle being axially aligned.

11. The exercise device of claim 10, wherein the second end of the member of each stopping device is integral with one of the handles and extends axially from the handle.

12. The exercise device of claim 11, wherein each stopping device further comprises a receiving portion for retaining a marginal end of the cord.

13. The exercise device of claim 12, wherein the receiving portion of the member of each stopping device extends longitudinally away from the handle integral with the stopping member and the axis of the portion is axially aligned with the bores of the member of the stopping device and the handle, whereby the cord may pass therethrough.

14. The exercise device of claim 13, wherein the receiving portion has a wall having an opening therein extending parallel to the bore and aligned with and open to the slot in the member of the stopping device, whereby the cord can pass through the opening in the wall of the receiving portion and into the slot in the member of the stopping device generally at a right angle to the aligned bores of the member and the handle.

15. The exercise device of claim 14, wherein each receiving portion is adapted to receive an enclosure enclosing a marginal end of the cord.

16. The exercise device of claim 15, wherein each receiving portion is adapted to receive a spherical member enclosing a marginal end of the cord.

17. The exercise device of claim 16, wherein each receiving portion is adapted to receive a spherical member enclosing the marginal end of the cord and the spherical member further enclosing a stopping member affixed to the cord at a marginal end thereof, whereby the spherical member is prevented from slipping off the end of the cord adjacent said marginal end.

18. An exercise device comprising:

a. a pair of handles, including a first handle and a second handle each having an inner end and an outer end and each having a longitudinal central bore therethrough;

b. an elastic cord extending longitudinally through the bores of said handles wherein the handles are slidable along the cord toward and away from each other and wherein the inner ends of the handles face each other;

d. a stopping device integral with the outer end of each handle, each stopping device comprising a member having a first end and a second end and having a bore therethrough through which the cord may pass, and a side wall having a slot extending parallel to the bore from said first end of the member toward said second end thereof, said slot tapering and narrowing from said first end toward said second end and terminating in a circular opening at least slightly larger than the narrowed end of the slot and forming a pair of pinch points therewith, wherein a cord passing from the bore into the slot at the first end of the member may be pulled through the slot at a right angle to the bore past the pair of pinch points and into the circular opening to permit the cord to expand slightly as it passes the pinch points and locks the cord in the circular opening of the stopping device, whereby the handle integral with the stopping device is prevented from moving along the cord;

e. each stopping device further comprising a receiving portion integral therewith and having a wall having an opening therein extending parallel to the bore and aligned with and open to the slot in the member of the stopping device, whereby the cord can pass through the opening in the wall of the receiving portion and into the slot in the member of the stopping device generally at a right angle to the bore of the member, and each receiving portion being adapted to receive a spherical enclosure enclosing a marginal end of the cord; and f. a spherical member enclosing the marginal end of the cord and a stopping member affixed to the cord at a marginal end thereof, whereby the spherical member is prevented from slipping off the end of the cord adjacent said marginal end.

* * * * *